US011125037B2

(12) United States Patent
Greci et al.

(10) Patent No.: US 11,125,037 B2
(45) Date of Patent: Sep. 21, 2021

(54) PACKER SETTING AND REAL-TIME VERIFICATION METHOD

(71) Applicant: Halliburton Energy Services, Inc., Houston, TX (US)

(72) Inventors: Stephen Michael Greci, Little Elm, TX (US); Thomas Jules Frosell, Irving, TX (US); Michael Linley Fripp, Carrollton, TX (US); Gary John Geoffroy, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 23 days.

(21) Appl. No.: 16/479,564

(22) PCT Filed: Apr. 30, 2018

(86) PCT No.: PCT/US2018/030256
§ 371 (c)(1),
(2) Date: Jul. 19, 2019

(87) PCT Pub. No.: WO2019/212499
PCT Pub. Date: Nov. 7, 2019

(65) Prior Publication Data
US 2020/0308922 A1 Oct. 1, 2020

(51) Int. Cl.
*E21B 23/06* (2006.01)
*E21B 33/127* (2006.01)
(Continued)

(52) U.S. Cl.
CPC ..... *E21B 23/06* (2013.01); *E21B 33/127* (2013.01); *E21B 33/1208* (2013.01);
(Continued)

(58) Field of Classification Search
CPC .... E21B 23/06; E21B 33/127; E21B 33/1272; E21B 33/1275; E21B 33/1285
See application file for complete search history.

(56) References Cited

U.S. PATENT DOCUMENTS 6,257,338 B1 * 7/2001 Kilgore ..... E21B 33/1246 166/187
7,762,325 B2 * 7/2010 Ellson ..... E21B 33/1285 166/187

(Continued)

FOREIGN PATENT DOCUMENTS

WO 2003089760 A1 10/2003
WO 2014092836 6/2014

OTHER PUBLICATIONS

ISRWO International Search Report and Written Opinion for PCT/US2018/030256 dated Jan. 29, 2019.

(Continued)

*Primary Examiner* — Cathleen R Hutchins
(74) *Attorney, Agent, or Firm* — Scott Richardson; C. Tumey Law Group PLLC

(57) ABSTRACT

This disclosure may generally relate to subterranean operations and, more particularly, to systems and methods for setting a packer. Specifically, embodiments of the present disclosure may provide real-time verification of setting a packer in order to form a seal within a wellbore. A system for packer setting may comprise a packer, a telemetry module operable to wirelessly receive one or more control signals from a surface location, and a control module coupled to the telemetry module and the packer, wherein the control module is operable to actuate the packer in response to the one or more control signals from the surface location.

20 Claims, 7 Drawing Sheets

(51) Int. Cl.
*E21B 33/12* (2006.01)
*E21B 33/128* (2006.01)
*E21B 47/18* (2012.01)

(52) U.S. Cl.
CPC ..... *E21B 33/128* (2013.01); *E21B 47/18* (2013.01); *E21B 2200/01* (2020.05); *E21B 2200/06* (2020.05)

(56) References Cited

U.S. PATENT DOCUMENTS

2002/0096325 A1 7/2002 Sonnier
2003/0042026 A1* 3/2003 Vinegar ..... E21B 43/12 166/369
2004/0112597 A1* 6/2004 Hamid ..... E21B 33/1285 166/250.17
2005/0028972 A1* 2/2005 Wilson ..... E21B 47/06 166/250.17
2009/0218107 A1 9/2009 Chauffe
2010/0149919 A1 6/2010 Segal
2016/0230505 A1 8/2016 Garcia et al.
2017/0081938 A1* 3/2017 Richards ..... E21B 33/1275
2017/0284168 A1* 10/2017 Zevenbergen ..... E21B 33/1208

OTHER PUBLICATIONS

Azerbaijanian Patent Search Report and Written Opinion with English Translation for Application No. 20200083 dated Apr. 8, 2021.
"Experience, current problems and prospects for the development of the oil and gas complex", A collection of works of the International Scientific and Practical Conference, published on Apr. 27, 2018 (Chebykina).

* cited by examiner

PACKER SETTING AND REAL-TIME VERIFICATION METHOD

BACKGROUND

Wells may be drilled into subterranean formations to recover valuable hydrocarbons. Various operations may be performed before, during, and after the well has been drilled to produce and continue the flow of the hydrocarbon fluids to the surface.

A typical operation concerning oil and gas operations may be to set a packer within a well. Packers may provide seals between the outside of a production tubing and the inside of a casing string, liner, or the wall of a wellbore. Packers may isolate and contain produced fluids and pressures within the wellbore. Other various uses may include preventing downhole movement of a tubing string, supporting a portion of the tubing string weight, and separating multiple production zones. The process of setting a packer may be inefficient. There are various ways to set a packer based on its design. Operation is typically done on the surface with limited knowledge of equipment placement and equipment actuation while downhole. It may be suitable to provide feedback on the setting procedure to verify that a packer has been properly set.

BRIEF DESCRIPTION OF THE DRAWINGS

These drawings illustrate certain aspects of the present disclosure, and should not be used to limit or define the disclosure.

DETAILED DESCRIPTION

This disclosure may generally relate to subterranean operations and, more particularly, to systems and methods for setting a packer. Specifically, embodiments of the present disclosure may provide real-time verification of setting a packer in order to form a seal within a wellbore. A packer setting assembly may be used to provide feedback to the surface on packer setting conditions. Additional tools and equipment may be used to relay information from downhole to the surface.

Figure 1A:
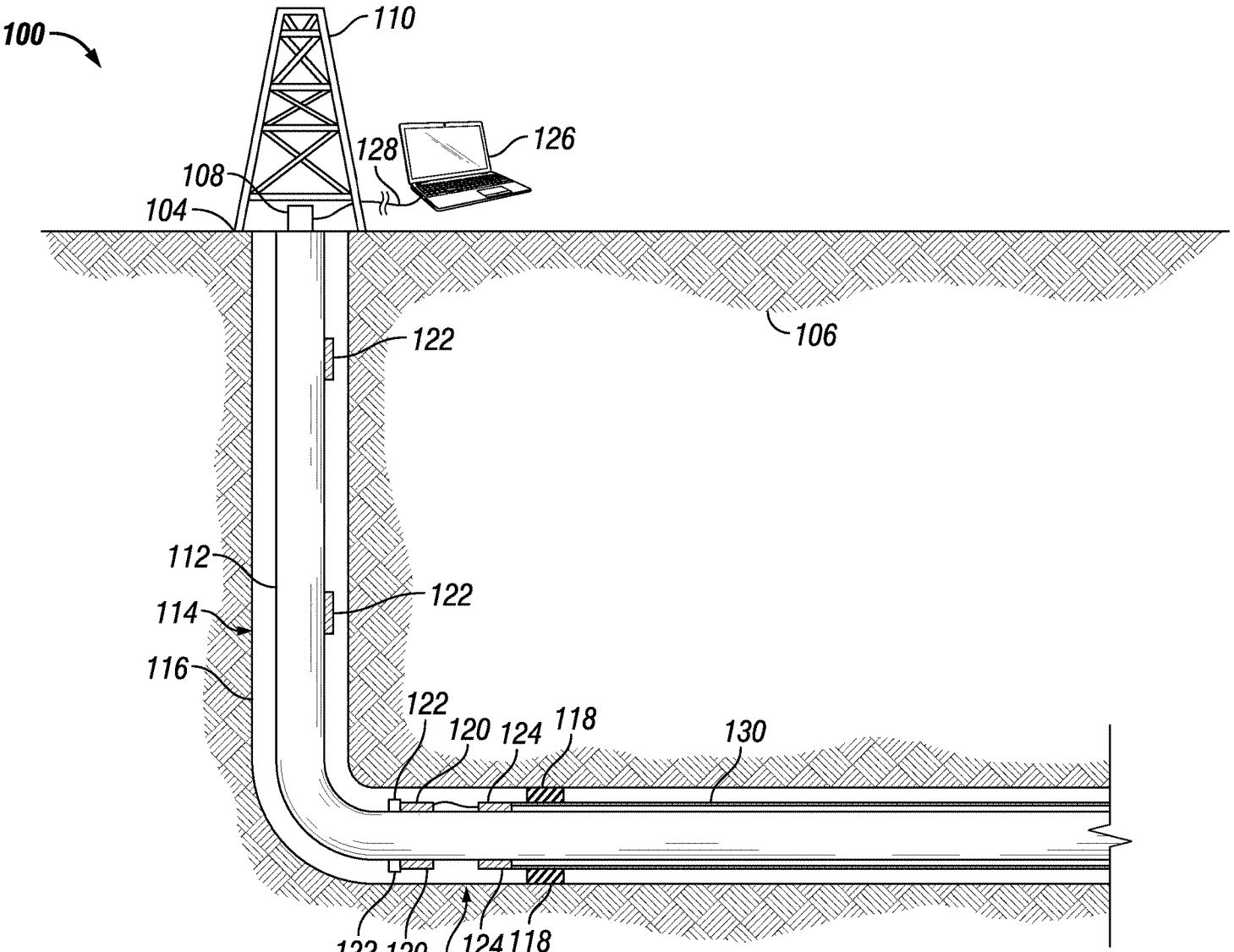
FIGS. 1A and 1B illustrate a downhole system with a packer setting assembly.

FIG. 1A illustrates a downhole system 100 that includes a packer setting assembly 102. Surface equipment 104 may be disposed above a formation 106. As illustrated, surface equipment 104 may include a hoisting apparatus 108 and a derrick 110. Hoisting apparatus 108 may be used for raising and lowering pipe strings, such as a conveyance line 112. Conveyance line 112 may include any suitable means for providing mechanical conveyance for packer setting assembly 102, including, but not limited to, wireline, slickline, coiled tubing, tubing string, pipe, drill pipe, drill string or the like. In some examples, conveyance line 112 may provide mechanical suspension, as well as electrical connectivity, for packer setting assembly 102. As illustrated, packer setting assembly 102 may be disposed on and/or around conveyance line 112. This may allow an operator to remove packer setting assembly 102 and use packer setting assembly 102 for another wellbore.

As illustrated, packer setting assembly 102 may be run into wellbore 114 on conveyance line 112. Wellbore 114 may extend through the various earth strata including formation 106. A casing 116 may be secured within wellbore 114 by cement (not shown). Casing 116 may be made from any material such as metals, plastics, composites, or the like, may be expanded or unexpanded as part of an installation procedure. Additionally, it is not necessary for casing 116 to be cemented into wellbore 114. In examples, production tubing 130 may be secured within casing 116. Production tubing 130 may be any suitable tubing string utilized in the production of hydrocarbons. In examples, production tubing may be permanently disposed within casing 116 by cement (not shown). Components of packer setting assembly 102 may be disposed on or near production tubing 130.

Packer setting assembly 102 may include a packer 118, a control module 120, and a telemetry module 122. As illustrated, control module 120 and telemetry module 122 may disposed on conveyance line 112 and packer 118 may be disposed on production tubing 130. However, it should be understood that these components of packer setting assembly 102 may be otherwise disposed in wellbore 114.

Without limitation, any suitable type of packer 118 may be used. Suitable types of packers may include whether they are permanently set or retrievable, mechanically set, hydraulically set, and/or combinations thereof. Packer 118 may be set downhole to seal off a portion of wellbore 114. When set, packer setting assembly 102 may isolate zones of the annulus between wellbore 114 and a tubing string by providing a seal between production tubing 130 and casing 116. In examples, packer 118 may be disposed on production tubing 130. The remaining components within packer setting assembly 102 may be disposed around conveyance line 112 and run into wellbore 114 when desired for use. Packer setting assembly 102 may temporarily couple to packer 118 to initiate a sealing operation within wellbore 114.

Control module 120 may include equipment to actuate packer 118 for operation (as described further below). Control module 120 may monitor the operation of packer 118 and send that information uphole via telemetry module 122. Telemetry module 122 may a component of control module 120 or a separate component that communicates with control module 120. Control module 120 may also receive information from the surface via telemetry module 122. Telemetry module 122 may be configured to transmit information, and receive information from, the surface. For example, telemetry module 122 may transmit information, such as pressure, pump revolutions, and stroke, among others, regarding operation of packer setting assembly 102 in setting packer 118. Information may be transmitted from telemetry module 122 to surface using any suitable unidirectional or bidirectional wired or wireless telemetry system, including, but not limited to, an electrical conductor, a fiber optic cable, acoustic telemetry, electromagnetic telemetry, pressure pulse telemetry, combinations thereof or the like. By way of example, telemetry module 122 may include acoustic and/or vibratory devices that send and receive acoustic signals along the conveyance line 112. Where acoustic telemetry may be used, the acoustic signals may be transmitted to/from telemetry module 122 through the conveyance line 112 and or fluid (not shown) in wellbore 114. As illustrated, one or more telemetry modules 122 may be positioned in wellbore 114. As illustrated, one or more telemetry modules 122 are spaced on conveyance line 112. One or more telemetry modules 122 may form a real-time, two-data transmission from packer setting assembly 102 to surface. This may allow an operator at the surface to send and/or receive information from packer setting assembly 102.

Packer setting assembly 102 may also include packer setting device 124. When run into the wellbore 114, for example, packer setting assembly 102 may releasably secure to packer 118. Packer setting device 124 may then be actuated, for example, by control module 120, to actuator packer 118. Packer setting device 124 may be run into the wellbore 114 after the production tubing is run. Once in location, the packer setting device 124 may create a hydraulic circuit with the packer 118 that has been previously installed. A wireless and/or wired signal may be sent to the packer setting device 124 and the packer setting device 124 may begin to set the packer 118 by activating a downhole hydraulic pump to pump fluid into the packer 118, which causes a piston to move, thereby compressing the seal element and/or moving the slips out to the casing/open hole. After the packer 118 is set and confirmed, the packer setting device 124 may be hydraulically disconnected from the packer 118 and pulled back to the surface. A packer setting device 124 may also be run into location after the packer 118 was previously run, and mechanically latch into the packer 118. Then, the wireless and/or wired signal may turn the hydraulic pump on and move a piston, which mechanically pushes on the packer 118 to set it.

Downhole system 100 may also include an information handling system 126. Information handling system 126 may be used to communicate with control module 120 during operation. The information handling system 126 may be in signal communication with control module 120, for example, by way of one or more telemetry modules 122. Without limitation, signals from control module 120 may be transmitted through one or more telemetry modules 122, which may be disposed throughout wellbore 114. Telemetry modules 122 may operate to pass information and/or measurements between information handling system 126 and control module 120. Information handling system 126 may be disposed at a surface location. In alternate embodiments, information handling system 126 may be disposed downhole. Without limitation, information handling system 126 may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, the information handling system 126 may be a personal computer, a network storage device, or any other suitable device and may vary in size, shape, performance, functionality, and price. Information handling system may include random access memory (RAM), one or more processing resources (e.g. a microprocessor) such as a central processing unit (CPU) or hardware or software control logic, ROM, and/or other types of nonvolatile memory. In examples, information handling system 126 may include a processing unit (e.g., a central processor), a monitor, an input device (e.g., keyboard, mouse, etc.) as well as computer media (e.g., optical disks, magnetic disks) that can store code for processing receiving information. Information handling system 126 may be operable to receive information from telemetry module 122 via communication link 128, which may be any suitable wired or wireless communication technique. Information handling system 126 may be adapted to receive signals from telemetry module 122 that may be representative of measurements from control module 120 disposed on conveyance line 112. Information handling system 126 may be adapted to transmit signals to telemetry module 122 and/or control module 120. Information handling system 126 may act as a data acquisition system and possibly a data processing system that analyzes measurements, for example, measurements and/or information from control module 120.

It should be understood by those skilled in the art that present examples are equally well suited for use in wellbores having other directional configurations including vertical wellbore, horizontal wellbores, deviated wellbores, multilateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts an onshore operation, it should be understood by those skilled in the art that the packer assemblies of the present invention are equally well suited for use in offshore operations. In addition, while FIG. 1 depicts use of packer 118 in a cased portion of wellbore 114, it should be understood that packer 118 may also be used in uncased portions of wellbore 114.

Figure 1B:
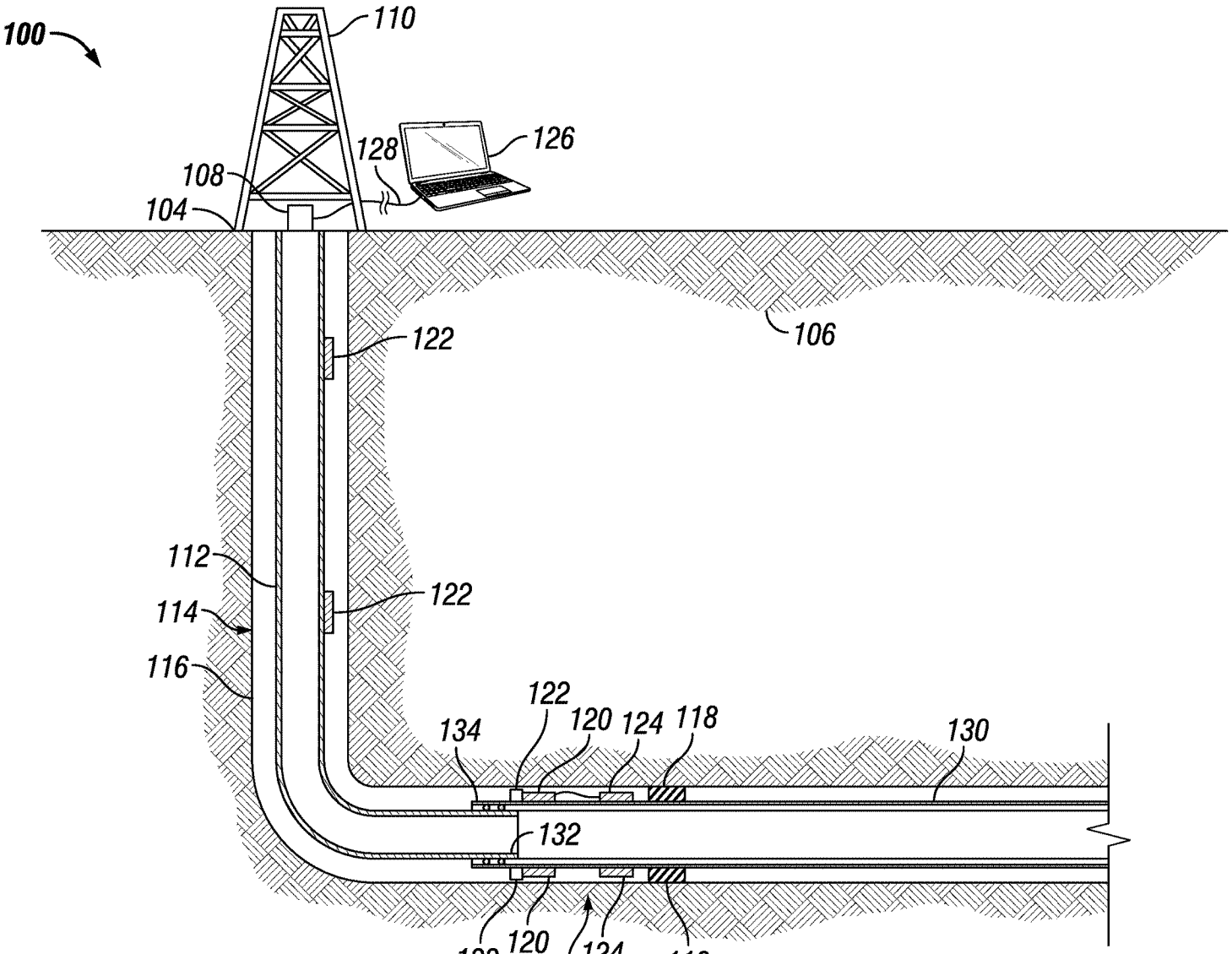

FIG. 1B illustrates another example of a downhole system 100 that includes a packer setting assembly 102. As illustrated, casing 116 and production tubing 130 may be disposed in wellbore 114. Conveyance line 112 may also be run into wellbore 114 and secured, for example, to production tubing 130. In contrast to FIG. 1A in which control module 120 and packer setting device 124 are disposed on conveyance line 112, the example shown on FIG. 1B provides control module 120 and packer setting device 124 on production tubing 130. As illustrated, at least one of telemetry modules 122 may also be disposed on production tubing 130. In some embodiments, placement of these components of packer setting assembly 102 may allow for a permanent installation in wellbore 114. Packer setting assembly 102 may be secured at any suitable location on production tubing 130. For example, packer setting assembly 102 may be disposed at an end of production tubing 130 as shown on FIG. 1B. In examples, conveyance line 112 may travel downhole through wellbore 114. An end 132 of conveyance line 112 may couple to an end 134 of production tubing 130. After conveyance line 112 is coupled to production tubing 130, an operator may actuate packer setting assembly 102 to packer 118 to form a seal between casing 116 and production tubing 130.

Figure 2:
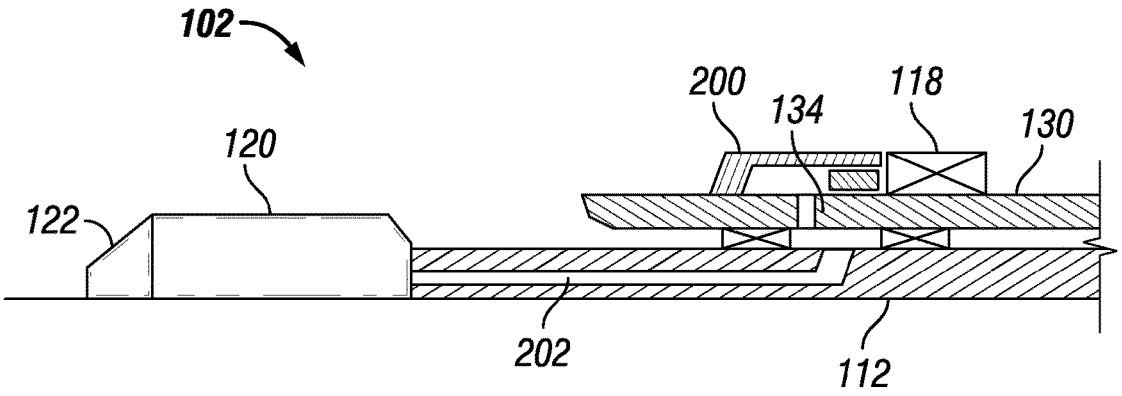
FIG. 2 illustrates a packer setting assembly in a wellbore.

Referring now to FIG. 2, packer setting assembly 102 is shown disposed on a conveyance line 112 that is coupled to a production tubing 130. Packer setting assembly 102 may a control module 120 and a telemetry module 122, both of which are disposed on conveyance line 112. Packer setting assembly 102 may also include packer setting device 200. As illustrated, packer setting device 200 may be disposed on production tubing 130. Typically, the packer setting device 200 may be attached to the packer 118 and run on the production tubing 130 with the packer 118. Once in location, a wireless and/or wired signal may be sent to the packer setting device 200 and the packer setting device 200 may begin to set the packer 118 by activating a downhole hydraulic pump to hydraulically move a piston, and thereby compressing the element and/or moving the slips out to the casing and/or inner surface of the wellbore. During the process, the packer setting device 200 may be unlatched from the packer 118 to allow for retrieval of the hydraulic pump and associated electronics. Conveyance line 112 may be extend into production tubing 130 and couple to an end 134 of production tubing 130, which may be secured within casing 116 of wellbore 114 by cement (e.g., referring to FIGS. 1A and 1B). Control module 120 may monitor the operation of and/or instruct packer setting device 200 to actuate packer 118. For example, control module 120 may receive a command (by way of telemetry module 122) from surface to set packer 118. Telemetry module 122 may be configured to transmit information, and receive information from, the surface. As illustrated, there may be channels 202 within packer setting assembly 102. Channels 202 may direct the flow of a hydraulic fluid in order to pressurize packer 118. In examples, a hydraulic fluid may travel through channels 202 and into packer setting device 200. Packer setting device 200 may be forced to push against packer 118. As packer 118 is acted upon, packer 118 may radially expand to set against an inner surface of wellbore 114.

Figure 3:
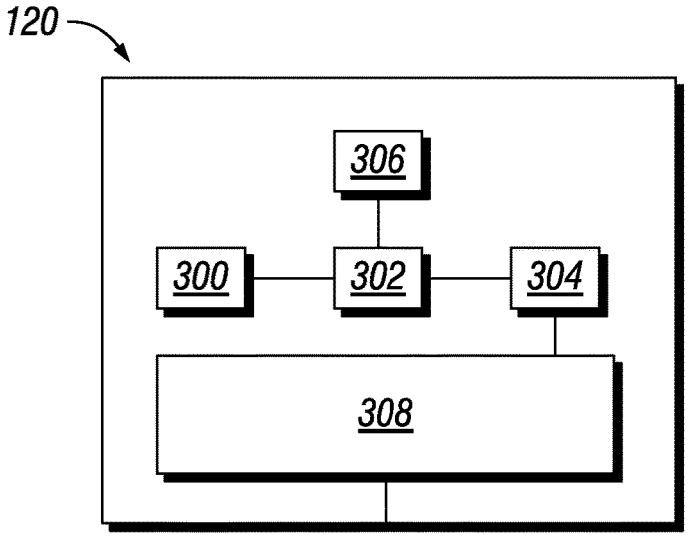
FIG. 3 illustrates a schematic diagram of a control module.

FIG. 3 is a schematic diagram illustrating an embodiment of control module 120 in more detail. Control module 120 may serve to monitor and/or influence the operation of packer 118 (e.g., referring to FIG. 1). Control module 120 may include a motor 302, a pump 304, a controller 306, and/or combinations thereof. Motor 302 may be used, for example, to produce mechanical energy. Without limitation, any suitable electric motor may be used, including, magnetic, electrostatic, piezoelectric, and/or combinations thereof. Motor 302 may require energy to produce the mechanical energy. While not shown, a power source may be included within control module 120 to provide the motor with electrical energy (e.g., a battery). In alternate embodiments, conveyance line 112 (e.g., referring to FIG. 1) may be able to provide the required electrical energy to power motor 302. Pump 304 may use the produced mechanical energy to move a fluid into packer setting device 200 (e.g., referring to FIG. 2). Without limitation, any suitable pump may be used, including, rotary hydraulic, piezoelectric, solenoid, and/or combinations thereof. As illustrated, control module 120 may include a reservoir 308 within control module 120 containing a hydraulic fluid to be used by pump 304. In alternate embodiments, a fluid may be pumped from the surface, through conveyance line 112, through control module 120, and to packer setting device 200. In embodiments, controller 306 may control any and/or all equipment within control module 120. Controller 306 may be any suitable device able to energize the actuation of a tool. Controller 306 may energize motor 302 to start producing mechanical energy, energize pump 304 to start pumping a fluid, stop a process, and/or combinations thereof. In embodiments, controller 306 may be able to send and/or receive signals.

Control module 120 may include one or more sensors 300 to take measurements of packer 118 and/or wellbore 114 (e.g., referring to FIG. 1). Without limitation, the one or more sensors 300 may include pressure gauges, thermocouples, flow meters, magnetometers, voltmeters, current sensors, accelerometers, force gauges, strain gauges, load cells, piezoelectric sensors, and/or combinations thereof. Controller 306 may energize a sensor 300 to start taking measurements. Measurements from sensor 300 may provide an operator with real-time feedback and verification that packer 118 has been set within wellbore 114. Measurements from sensor 300 may include, but are not limited to, pressure, temperature, strain, distance, force, vibration, flow rate, flow volume.

Figure 4:
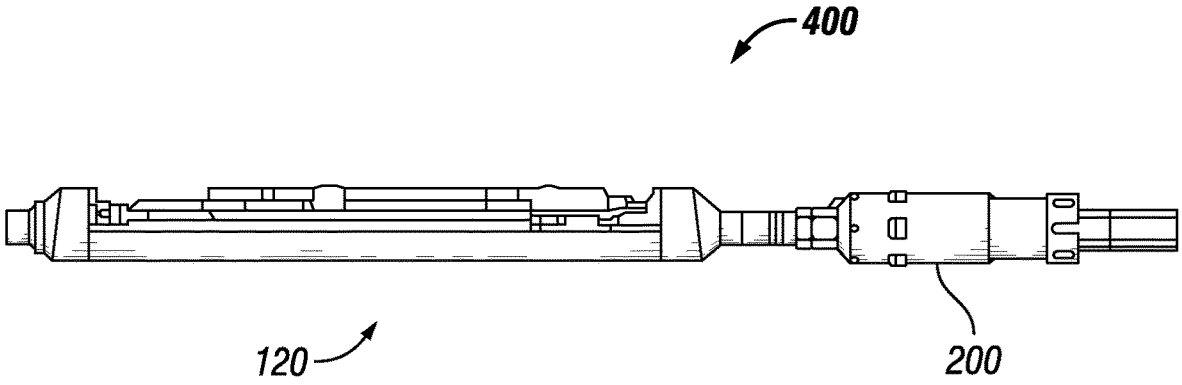
FIG. 4 illustrates a control module coupled to a packer setting device.

Referring now to FIG. 4, tool string 400 is provided. As illustrated, tool string 400 includes control module 120 and packer setting device 200. For simplicity, packer 118 and telemetry module 122 are not shown. As illustrated, control module 120 may be disposed at an end of a packer setting device 310. With additional reference to FIG. 2, packer setting device 310 may mechanically latch to packer 118. Packer setting device 310 may be any suitable size, height, and/or shape which may accommodate an end of packer 118. Without limitation, a suitable shape may include, but is not limited to, cross-sectional shapes that are circular, elliptical, triangular, rectangular, square, hexagonal, and/or combinations thereof. Packer setting device 310 may be made from any suitable material. Suitable materials may include, but are not limited to, metals, nonmetals, polymers, ceramics, and/or combinations thereof. In embodiments, packer setting device 310 may indirectly couple control module 120 to packer 118. Packer setting device 310 may be actuated to separate control module 120 from packer 118 once packer 118 has been set within wellbore 114 (e.g., referring to FIG. 1). In other embodiments, packer setting device 310 may be actuated to connect packer 118 to control module 120 for a retrieval process.

Referring to FIGS. 1, 2, and 4, control module 120 may be threadably coupled to conveyance line 112 (e.g., referring to FIG. 1). Control module 120 may be disposed above or below packer 118 while in line with conveyance line 112. Control module 120 may be any suitable size, height, and/or shape. Without limitation, a suitable shape may include, but is not limited to, cross-sectional shapes that are circular, elliptical, triangular, rectangular, square, hexagonal, and/or combinations thereof. Control module 120 may be made from any suitable material. Suitable materials may include, but are not limited to, metals, nonmetals, polymers, ceramics, and/or combinations thereof.

With continued reference to FIGS. 1, 2, and 4, an operator may dispose packer setting assembly 102 downhole in wellbore 114. Packer setting assembly 102 may stop descending once it reaches a designated depth. The information handling system 126 may send signals to packer setting assembly 102. In embodiments, these signals may be received by control module 120 by way of telemetry module 122. Control module 120 may actuate packer 118 to set against the inner wall of wellbore 114. With additional reference to FIG. 3, packer 118 may be hydraulically actuated with pump 304 disposed within control module 120. Without limitation, sensors 300 within control module 120 may be able to take measurements concerning the pressure build-up within packer 118 and the revolutions per minute of pump 304. Control module 120 may send signals back to the information handling system 126 for data processing. An operator may be able to obtain the setting force with pressure data and knowledge of the piston area within packer 118. The information handling system 126 may be able to determine displacement of the fluid with the revolutions per minute of the pump data. Without limitation, the information handling system 126 may also be able to determine the setting stroke of packer 118, pump output flow, pump efficiency, and/or combinations thereof. Analysis of the described properties may provide feedback to an operator on the condition of packer 118.

As previously described, one property that may be monitored to determine condition of packer 118 may include pressure. Pressure may be monitored, for example, with sensors 300. The pressure may be monitored at any suitable location, including, but not limited to, proximate to a pump, proximate to the packer 118, in the flow path between the pump and the packer 118, in gauges within the packer setting assembly 102 that communicate back to the surface, and/or combinations thereof. By way of example, steady increases in pressure over time may indicate proper setting of packer 118 as increased resistance may be observed as packer 118 may be placed into its proper position. However, rapid pressure spikes in pressure may indicate a problem with packer 118 deployment. Similarly, minor to no increase in observed pressure may also indicate a problem with packer 118 deployment. Another property that may be monitored to determine condition of packer 118 may include flow rate. Flow rate may be monitored, for example, with sensors 300. The flow rate being monitored may be the flow rate of hydraulic fluid being delivered to packer 118 by way of pump 304. By way of example, steady decreases in flow rate over time may indicate proper setting of packer 118 as increased resistance to fluid flow may be observed as packer 118 may be placed into its proper position. However, rapid pressure decreases in flow rate may indicate a problem with packer 118 deployment. Similarly, minor to no decreases in observed flow rate may also indicate a problem with packer 118 deployment. Additionally, the setting stroke of operating packer 118 may be calculated by knowing the volume of the fluid displaced, which may also be observed through sensors 300.

Figure 5A:
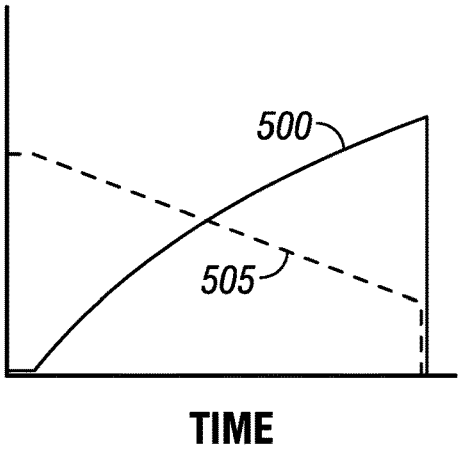
FIGS. 5A-5C illustrate graphs depicting pressure and flow rate relationships.
Figure 5B:
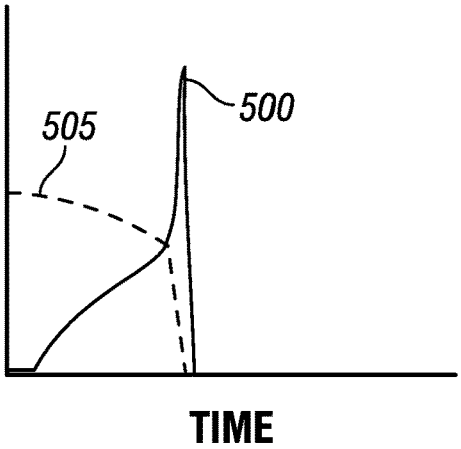
Figure 5C:
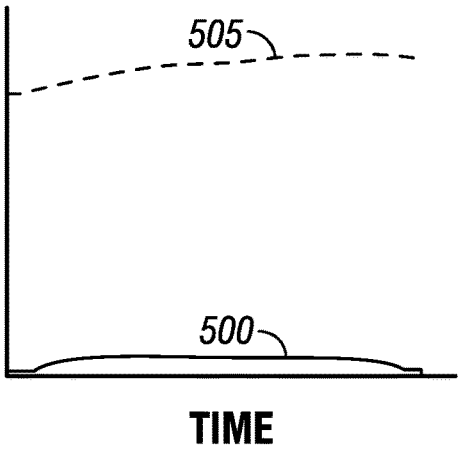

FIGS. 5A-5C illustrate varying graphs depicting pressure and flow rate as a function of time. Pressure is indicated on FIGS. 5A-5C by line 500 while flow rate is indicated on FIGS. 5A-5C by line 505. As previously described, the pressure and flow rate are properties that may be monitored to determine proper setting of packer 118. Pressure and flow rate of hydraulic fluid being delivered from pump 304 (e.g., shown on FIG. 3) to actuate packer 118 may be monitored. FIG. 5A illustrates an example graph for a properly set packer. As shown, the pressure gradually increases as components within packer 118 (e.g., referring to FIG. 1) operate. The flow rate of hydraulic fluid decreases with the rise in pressure as components within packer 118 actuate. FIG. 5B illustrates an example graph for an improperly set packer. As shown, the pressure gradually increases and spikes before the proper volume of fluid was pumped. By way of example, this may indicate that a component within packer 118 is locked up or jammed, and packer 118 is not fully set. FIG. 5C illustrates another graph for an improperly set packer. As shown, the pressure does not increase. The fluid flow rate remains high because the pressure does not actuate. By way of example, this may indicate that the setting mechanism is detached from packer 118 and stroking freely without putting a load on other components within packer 118. Control module 120 (e.g., referring to FIG. 1) may provide real-time data to the information handling system. The information handling system 126 may display various graphs, similar to those illustrated in FIGS. 5A-5C, depicting conditions of packer 118 operation.

Figure 6A:
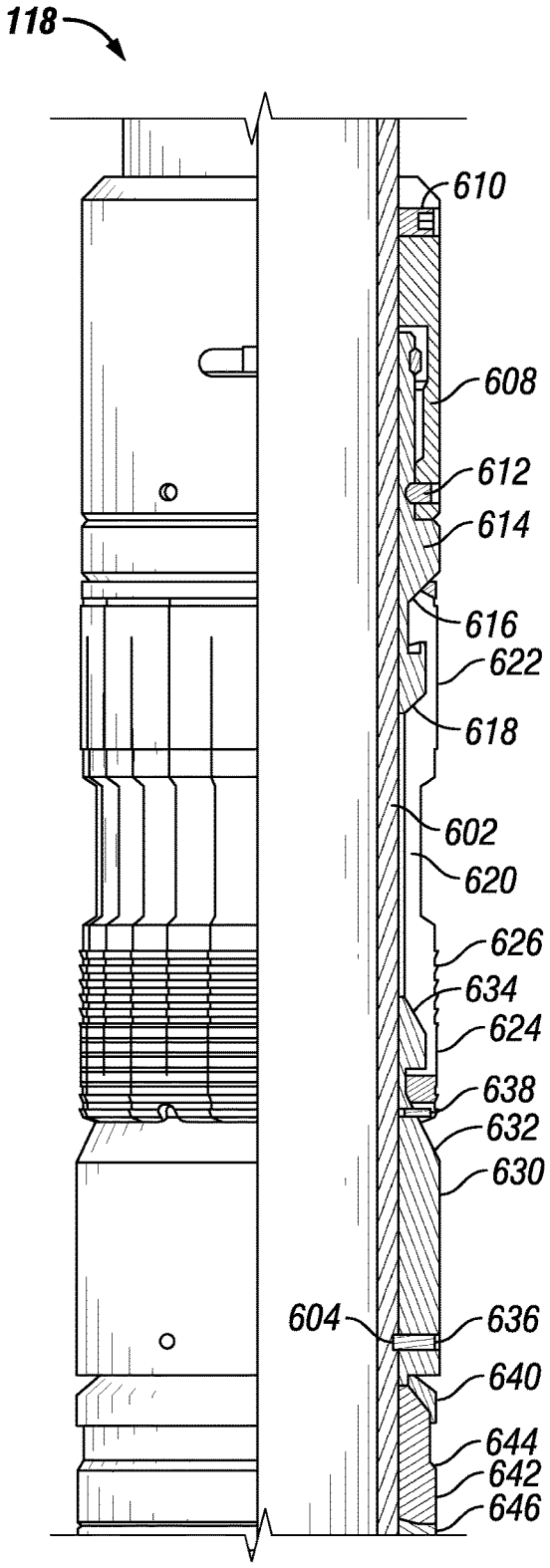
FIGS. 6A-6C illustrate a packer.
Figure 7A:
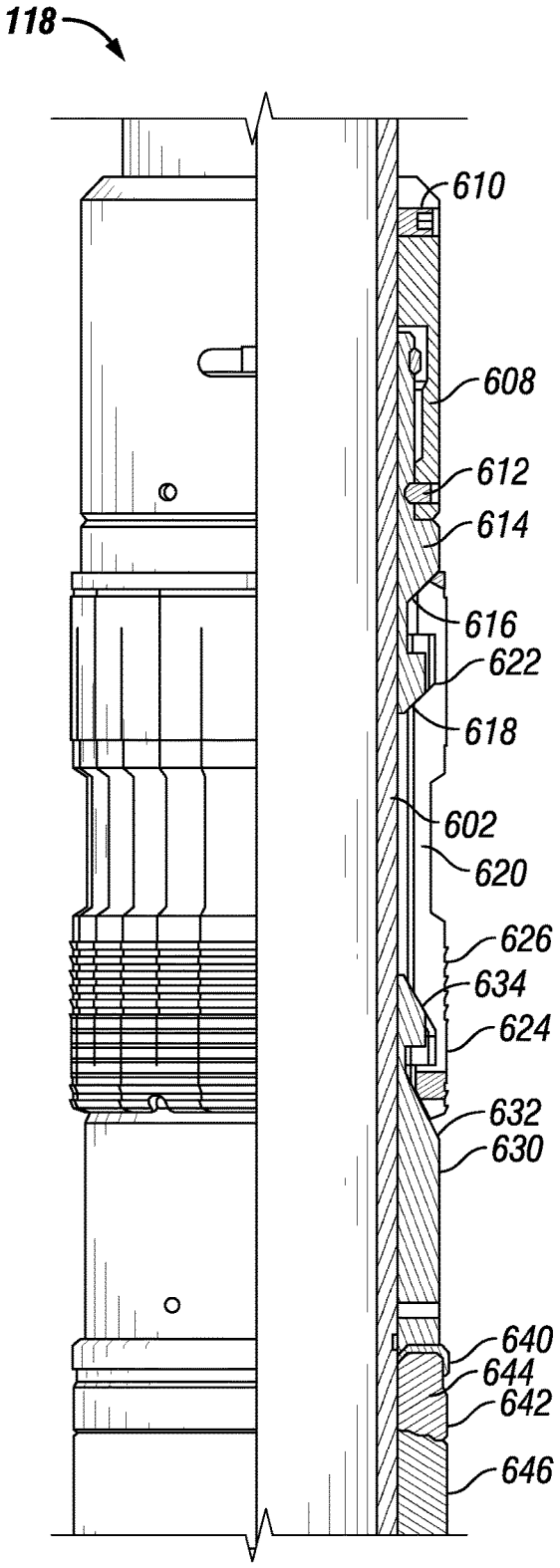
FIGS. 7A-7C illustrate a packer.
Figure 6B:
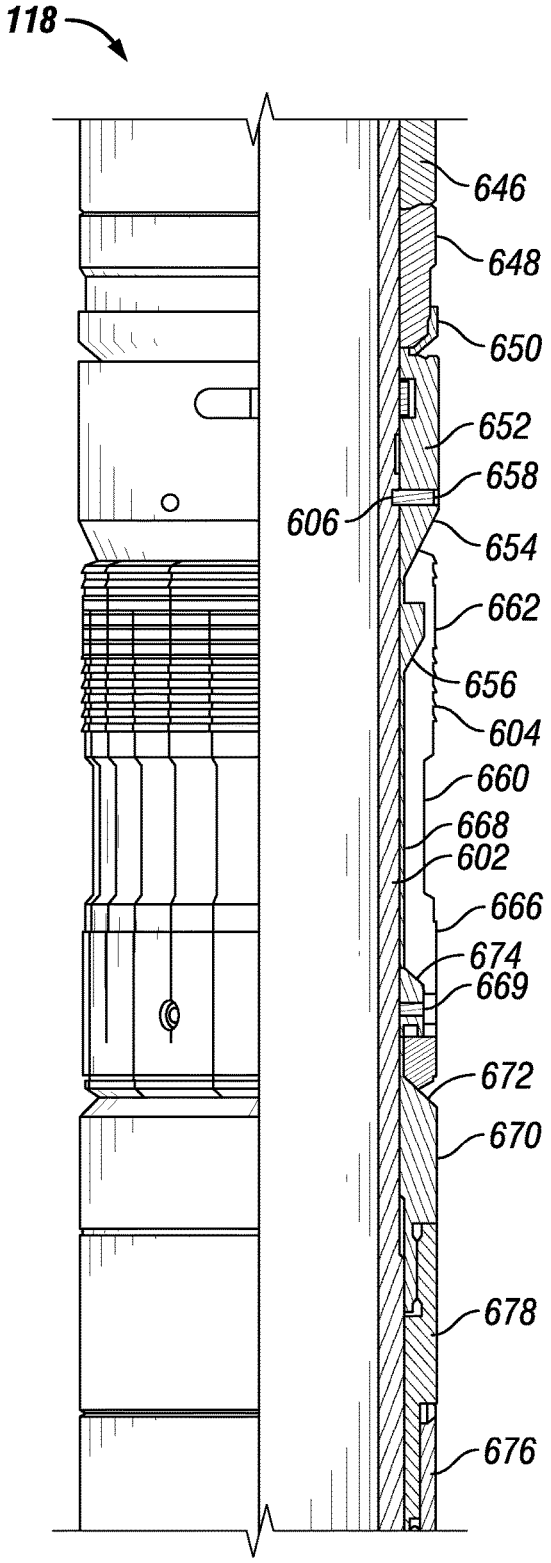
Figure 7B:
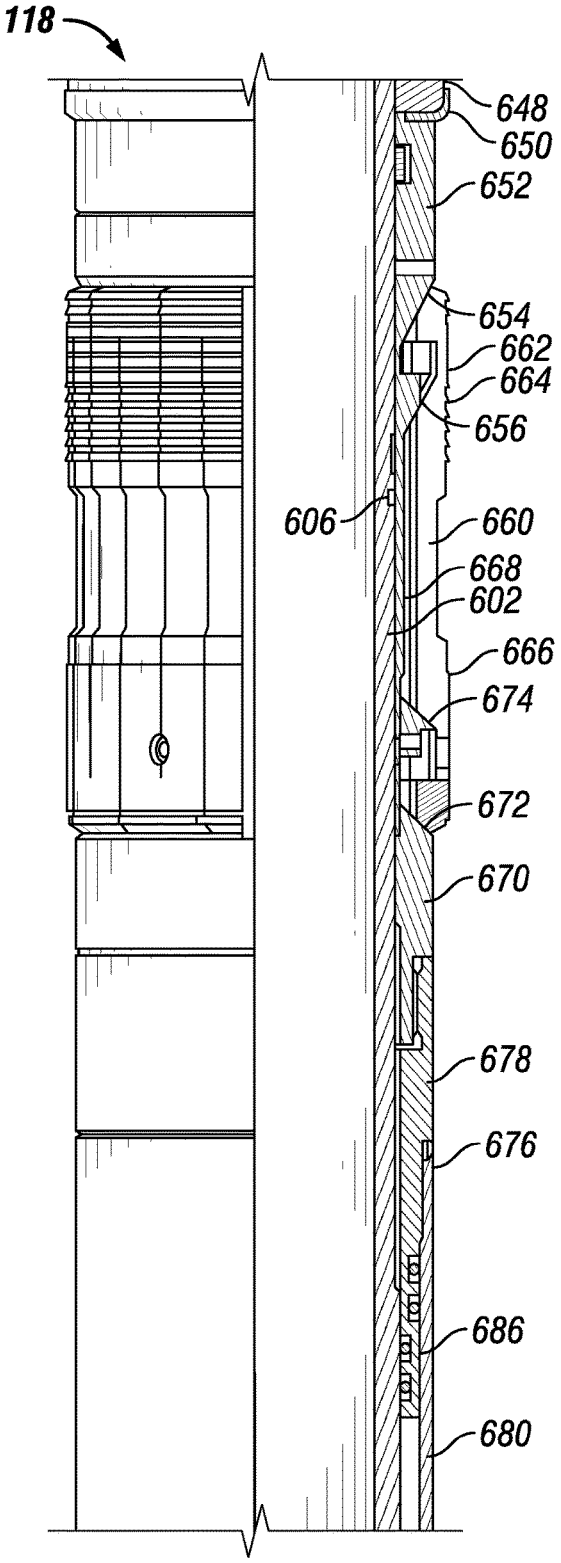
Figure 6C:
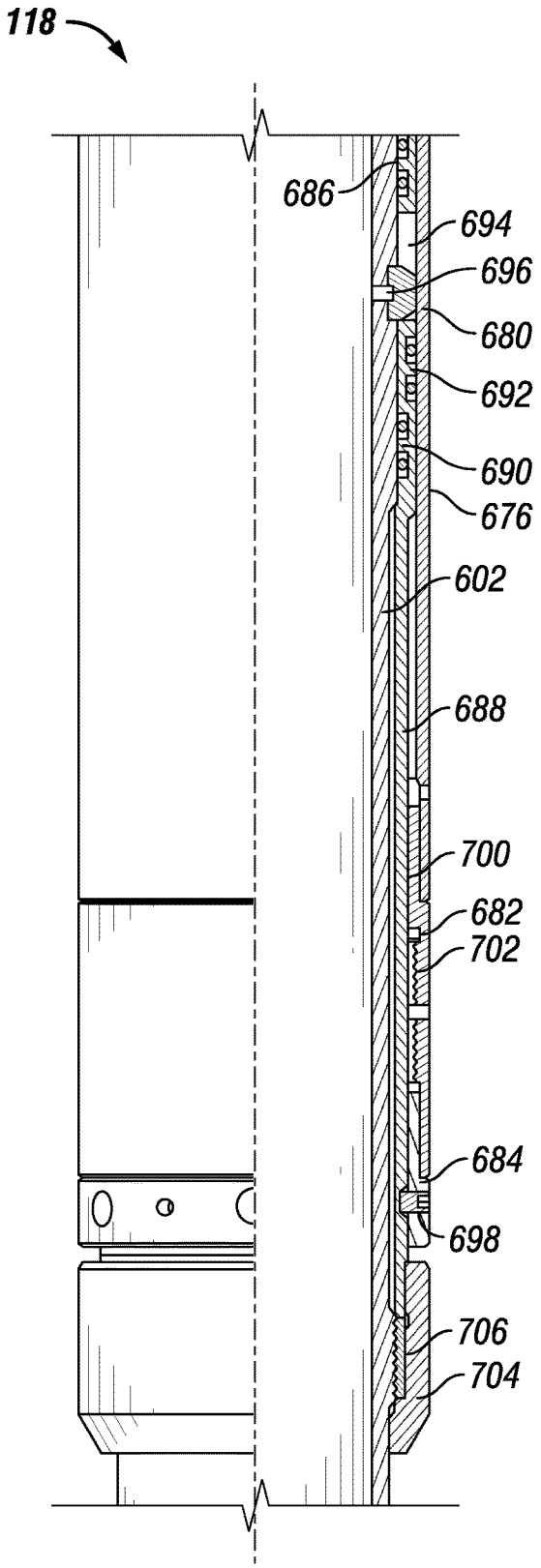
Figure 7C:
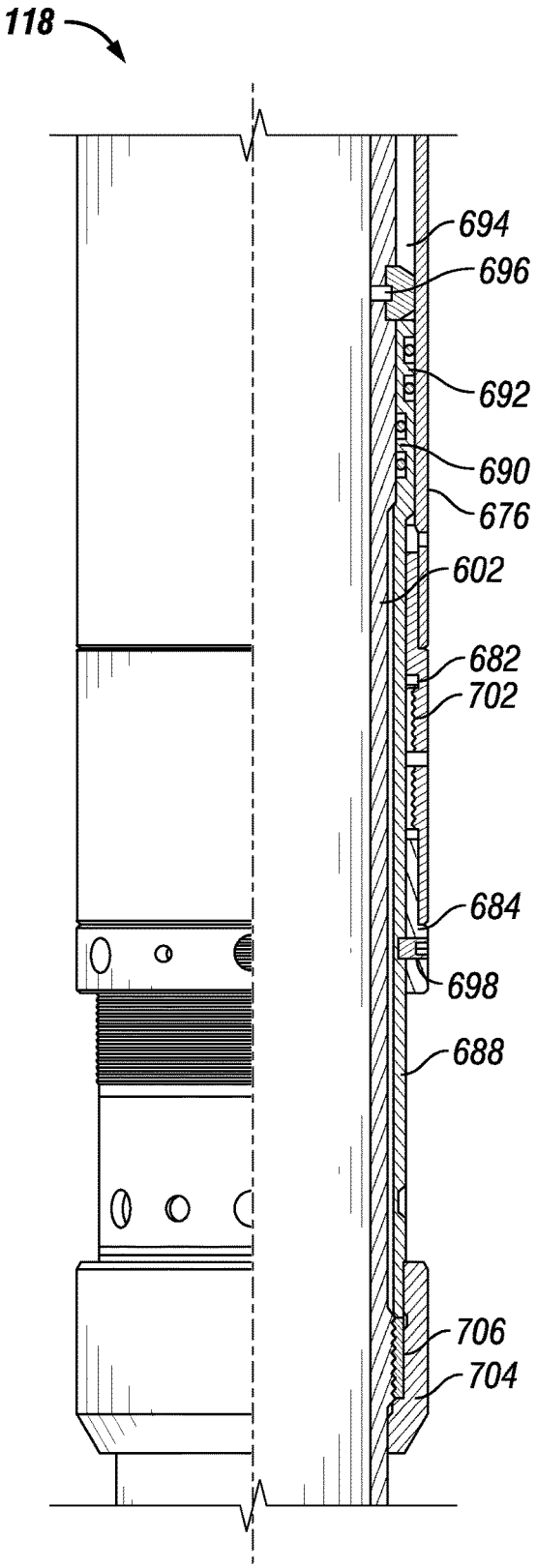

Referring now to FIGS. 6A-6C, therein are depicted successive axial sections of packer 118. It should be understood that FIGS. 6A-6C illustrate an example of packer 118 that may be used with the present technique and the present disclosure is intended to encompass other configurations of packer 118. Packer 118 may be threadably coupled to other downhole tools as part of conveyance line 112 (e.g., referring to FIG. 1). Packer 118 may include a packer mandrel 602. Packer mandrel 602 may include a pin groove 604, as best seen in FIG. 6A and a pin groove 606, as best seen in FIG. 6B. Positioned around an upper portion of packer mandrel 602 may be an upper housing section 608 that may be threadably coupled to packer mandrel 602. One or more threaded pins 610 may be used to secure upper housing section 608 against rotation. At its lower end, upper housing section 608 may be securely coupled by one or more pins 612 to a first wedge 614 that may be disposed about packer mandrel 602. First wedge 614 may include a pair of ramps 616, 618 that may be operable to engage an inner surface of an upper slip element 620 that may be disposed about packer mandrel 602. Upper slip element 620 may include a substantially cylindrical, non-directional contact surface 622 for diverting force to the wall of wellbore 114 (referring to FIG. 1) when set and a substantially cylindrical, directional gripping surface 624 depicted as including a plurality of teeth 626 for providing a gripping arrangement with the interior of the wall of wellbore 114 when set. As illustrated, upper slip element 620 is located between first wedge 614 and a second wedge 630 that may include a pair of ramps 632, 634. In the running configuration of packer 118 depicted in FIGS. 6A-6C, second wedge 630 may be securely coupled to packer mandrel 602 by one or more pins 636. In addition, upper slip element 620 may be prevented from moving up ramp 632 of second wedge 630 by one or more pins 638. As explained in greater detail below, when a compressive force is generated between first wedge 614 and second wedge 630, upper slip element 620 may be radially expanded into contact with the wall of wellbore 114.

An upper element backup shoe 640 that may be slidably positioned around packer mandrel 602 may be adjacent to second wedge 630. Additionally, a seal assembly 642, depicted as expandable seal elements 644, 646, 648, may be slidably positioned around packer mandrel 602 between upper element backup shoe 640 and a lower element backup shoe 650. Even though three expandable seal elements 644, 646, 648 are depicted and described, those skilled in the art will recognize that a seal assembly of the packer of the present invention may include any number of seal elements.

Upper element backup shoe 640 and lower element backup shoe 650 may be made from a deformable or malleable material, such as mild steel, soft steel, brass and the like and may be thin cut at their distal ends. The ends of upper element backup shoe 640 and lower element backup shoe 650 may deform and flare outwardly toward the inner surface of the wall of wellbore 114 during setting. In an embodiment, upper element backup shoe 640 and lower element backup shoe 650 may form metal-to-metal barriers between packer 118 and the inner surface the wall of wellbore 114.

A third wedge 652 may be disposed about packer mandrel 602 and include a pair of ramps 654, 656. In the running configuration of packer 118 depicted in FIGS. 6A-6C, third wedge 652 may be securely coupled to packer mandrel 602 by one or more pins 658. A lower slip element 660 that may be disposed about packer mandrel 602 may be below third wedge 652. Lower slip element 660 may include a substantially cylindrical, directional gripping surface 662 depicted as including a plurality of teeth 664 for providing a gripping arrangement with the interior of the wall of wellbore 114 when set and a substantially cylindrical, non-directional contact surface 666 for diverting force to the wall of wellbore 114 when set. A force ring 668 may be disposed between lower slip element 660 and packer mandrel 602. Lower slip element 660 may be located between third wedge 652 and a fourth wedge 670 that may include a pair of ramps 672, 674 that may be operable to engage an inner surface of lower slip element 660. Initially, fourth wedge 670 may be coupled to force ring 668 by one or more pins 669. As explained in greater detail below, when a compressive force is generated between third wedge 652 and fourth wedge 670, lower slip element 660 may be radially expanded into contact with the wall of wellbore 114.

A piston assembly 676 may be slidably disposed about packer mandrel 602 and coupled to fourth wedge 670 through a threaded connection. Piston assembly 676 may include an upper piston section 678, an intermediate piston section 680 that may be threadably and sealingly coupled to upper piston section 678, a lower piston section 682 that may be threadably coupled to intermediate piston section 680, and a retainer ring 684 that may be threadably coupled to lower piston section 682. Even though piston assembly 676 is depicted and described as having a particular number of sections, those skilled in the art will recognize that other arrangements of piston sections including a greater number or lesser number of piston sections including a single piston section could alternatively be used in the present invention. Upper piston section 678 may include a sealing profile 686 having multiple sealing elements that provide a seal with packer mandrel 602.

A lower cylinder 688 may be disposed between packer mandrel 602 and the lower sections of piston assembly 676. Lower cylinder 688 may include a sealing profile 690 having multiple sealing elements that may provide a seal with packer mandrel 602. Lower cylinder 688 may also include a second sealing profile 692 having multiple sealing elements that provide a seal with intermediate piston section 680. Packer mandrel 602 and intermediate piston section 680, as well as the seals of upper piston section 678 and lower cylinder 688, may define a setting chamber 694 that may be in fluid communication with one or more fluid ports 696 that extend through packer mandrel 602. Retainer ring 684 may be initially coupled to lower cylinder 688 by one or more frangible members depicted as shear screws 698. Lower cylinder 688 may include a serrated outer surface 700 that may be operable to interact with a body lock ring 702 disposed between lower cylinder 688 and lower piston section 682. At its lower end, lower cylinder 688 may be threadably coupled to a lower housing section 704. A lock ring 706 may be disposed between lower housing section 704 and packer mandrel 602 that may secure lower housing section 704 onto packer mandrel 602.

FIGS. 6A-6C and 7A-7C collectively illustrate an operating mode of packer 118 Packer 118 may be depicted before and after activation and expansion of expandable seal elements 644, 646, 648 and slip elements 620, 660, respectively, in FIGS. 6A-6C and 7A-7C. Packer 118 may be run into wellbore 114 on conveyance line 112 (referring to FIG. 1) to a desired depth and then set against a casing string, a liner string or wall of wellbore 114. Setting may be accomplished by increasing the tubing pressure within packer mandrel 602. The force generated by the fluid pressure acting on a surface of a piston area within packer 118 may cause expansion of expandable seal elements 644, 646, 648 against an inner surface of casing 116 and/or of wellbore 114.

In examples, control module 120 (e.g., referring to FIG. 1) may be coupled to packer 118. Pump 304 (e.g., referring to FIG. 3) may displace a hydraulic fluid from control module 120 (e.g., referring to FIG. 1) into packer 118. The pressure of the hydraulic fluid may be directed onto the piston area which may cause slip element 620 to be radially outwardly shifted by ramps 616, 618, 632, 634. This may set slip element 620 against the setting surface of wellbore 114. As slip element 620 sets, greater force may be applied between second wedge 630 and third wedge 652. This may apply a compressive force against seal assembly 642, which causes radial expansion of expandable seal elements 644, 646, 648 against the sealing surface of wellbore 114. In addition, the compressive forces may cause upper element backup shoe 640 and lower element backup shoe 650 to flare outward toward the sealing surface to provide a metal-to-metal seal against a casing or liner string (i.e., if wellbore 114 is cased).

In this manner, packer 118 may create a sealing relationship between expandable seal elements 644, 646, 648 and the sealing surface of wellbore 114. In addition, packer 118 may create a gripping relationship between directional gripping surface 624 of slip element 620, directional gripping surface 662 of slip element 660 and setting surfaces of wellbore 114. Further, packer 118 may create a contact relationship between non-directional contact surface 622 of slip element 620, non-directional contact surface 666 of slip element 660 and setting surfaces of wellbore 114. In this set configuration, directional gripping surface 624 of slip element 620 may oppose movement of slip element 620 in the uphole direction, and directional gripping surface 662 of slip element 660 may oppose movement of slip element 660 in the downhole direction. In addition, non-directional contact surface 622 of slip element 620 may divert force acting on slip element 620 in the downhole direction to the wellbore, and non-directional contact surface 666 of slip element 660 may divert force acting on slip element 660 in the uphole direction of wellbore 114.

The systems and methods for setting a packer may include any of the various features of the systems and methods disclosed herein, including one or more of the following statements.

Statement 1. A system for packer setting, comprising: a packer, a telemetry module operable to wirelessly receive one or more control signals from a surface location, and a control module coupled to the telemetry module and the packer, wherein the control module is operable to actuate the packer in response to the one or more control signals from the surface location Statement 2. The system of statement 1, wherein the control module comprises a controller, a pump, and a reservoir of hydraulic fluid.

Statement 3. The system of statement 2, wherein the pump comprises a rotary hydraulic pump.

Statement 4. The system of any of the previous statements, wherein the control module comprises at least one sensor.

Statement 5. The system of statement 4, wherein the at least one sensor comprises a pressure gauge.

Statement 6. The system of statement 4, wherein the at least one sensor comprises a flow meter.

Statement 7. The system of any of the previous statements, wherein the packer comprises a piston assembly, a seal element, and a slip element.

Statement 8. The system of any of the previous statements, wherein the telemetry module is operable to wirelessly transmit signals to the surface location, wherein the signals actuate the packer to set or unset.

Statement 9. The system of any of the previous statements, wherein the signals transmitted to the surface location comprise information related to one or more of pressure of hydraulic fluid, flow rate of hydraulic fluid, pump revolutions, setting stroke of the packer, volumetric flow, volumetric displacement, temperature, strain, distance, force, or vibration.

Statement 10. The system of any of the previous statements, wherein the system comprises a packer setting assembly in the form of a tool string, wherein the tool comprises the control module and a packer setting device at a distal end of the control module, wherein the packer setting device is mechanically latchable to the packer to secure the packer setting assembly to the packer.

Statement 11. The system of any of the previous statements, further comprising a plurality of transceivers spaced in a wellbore between the surface location and the telemetry module, wherein the plurality of transceivers are operable to wirelessly communicate the control signals from the surface location to the control module.

Statement 12. A method of setting a packer, comprising: transmitting one or more control signals from a surface location to a telemetry module disposed in a wellbore, pumping a hydraulic fluid to hydraulically actuate a packer in response to the one or more control signals, and setting the packer in the wellbore using the hydraulic fluid.

Statement 13. The method of statement 12, wherein the one or more control signals are transmitted to the surface location by way of wireless communication.

Statement 14. The method of statements 12 or 13, wherein the transmitting the one or more control signals from the surface location to the telemetry module comprises transmitting the one or more control signals to one or more transceivers disposed in the wellbore and then transmitting the one or more control signals from the one or more transceivers to the telemetry module.

Statement 15. The method of any of statements 12 to 14, further comprising transmitting one or more signals from the telemetry module to the surface location by way of wireless communication, wherein the one or more signals are indicative of packer operation.

Statement 16. The method of statement 15, wherein the one or more signals comprise information related to one or more of pressure of hydraulic fluid, flow rate of hydraulic fluid, pump revolutions, setting stroke of the packer, volumetric flow, volumetric displacement, temperature, strain, distance, force or vibration.

Statement 17. The method of any of statements 12 to 16, further comprising measuring one or more properties indicating of packer setting as the packer is set in the wellbore.

Statement 18. The method of statement 17, wherein the measuring comprises measuring pressure of the hydraulic fluid.

Statement 19. The method of statement 17, wherein the measuring comprises measuring flow rate of the hydraulic fluid.

Statement 20. The method of statement 17, further comprising displaying an image of the one or more properties as a function of time.

Although the present invention and its advantages have been described in detail, it should be understood that various changes, substitutions and alterations may be made herein without departing from the spirit and scope of the invention as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "including," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A system for packer setting, comprising:

a packer;

a telemetry module operable to wirelessly receive one or more control signals from a surface location;

a control module coupled to the telemetry module and the packer, wherein the control module is operable to actuate the packer in response to the one or more control signals from the surface location; and a conveyance line, wherein the control module is disposed on the conveyance line, wherein a channel extends through the conveyance line from the control module to an opening that is configured to pass hydraulic fluid in a radial direction away from the conveyance line to actuate the packer, wherein the opening is defined by an end of production tubing and a portion of a packer setting device, the conveyance line disposed radially inward from the opening.

2. The system of claim 1, wherein the control module comprises a controller, a pump, and a reservoir of hydraulic fluid.

3. The system of claim 2, wherein the pump comprises a rotary hydraulic pump.

4. The system of claim 1, wherein the control module comprises at least one sensor.

5. The system of claim 4, wherein the at least one sensor comprises a pressure gauge.

6. The system of claim 4, wherein the at least one sensor comprises a flow meter.

7. The system of claim 1, wherein the packer comprises a piston assembly, a seal element, and a slip element.

8. The system of claim 1, wherein the telemetry module is operable to wirelessly transmit signals to the surface location, wherein the signals actuate the packer to set or unset.

9. The system of claim 8, wherein the signals transmitted to the surface location comprise information relating to one or more of pressure of hydraulic fluid, flow rate of hydraulic fluid, pump revolutions, setting stroke of the packer, volumetric flow, volumetric displacement, temperature, strain, distance, force, or vibration.

10. The system of claim 1, wherein the system comprises a packer setting assembly in the form of a tool string, wherein the tool comprises the control module and the packer setting device at a distal end of the control module, wherein the packer setting device is mechanically latchable to the packer to secure the packer setting assembly to the packer.

11. The system of claim 1, wherein the opening is in fluid communication with a chamber disposed between an outer surface of the conveyance line and an interior of the production tubing.

12. A method of setting a packer, comprising:

disposing a conveyance line into an interior of production tubing, wherein a control module is disposed on the conveyance line, wherein a channel extends through the conveyance line from the control module to an opening that is configured to pass hydraulic fluid in a radial direction away from the conveyance line to actuate the packer, wherein the opening is defined by an end of the production tubing and a portion of a packer setting device, the conveyance line disposed radially inward from the opening;

transmitting one or more control signals from a surface location to a telemetry module disposed in a wellbore;

pumping a hydraulic fluid to hydraulically actuate a packer in response to the one or more control signals; and setting the packer in the wellbore using the hydraulic fluid.

13. The method of claim 12, wherein the one or more control signals are transmitted to the surface location by way of wireless communication.

14. The method of claim 12, wherein the pumping comprises pumping the hydraulic fluid through the channel and the opening.

15. The method of claim 12, further comprising transmitting one or more signals from the telemetry module to the surface location by way of wireless communication, wherein the one or more signals are indicative of packer operation.

16. The method of claim 15, wherein the one or more signals comprise information related to one or more of pressure of hydraulic fluid, flow rate of hydraulic fluid, pump revolutions, setting stroke of the packer, volumetric flow, volumetric displacement, temperature, strain, distance, force, or vibration.

17. The method of claim 12, further comprising measuring one or more properties indicating of packer setting as the packer is set in the wellbore.

18. The method of claim 17, wherein the measuring comprises measuring pressure of the hydraulic fluid.

19. The method of claim 17, wherein the measuring comprises measuring flow rate of the hydraulic fluid.

20. The method of claim 17, further comprising displaying an image of the one or more properties as a function of time.

* * * * *